US009545349B2

(12) United States Patent
Kalka et al.

(10) Patent No.: US 9,545,349 B2
(45) Date of Patent: Jan. 17, 2017

(54) BEDRAIL MOUNT

(71) Applicant: KONINKLIJKE PHILIPS N.V., Eindhoven (NL)

(72) Inventors: Roman Oliver Kalka, Stuttgart (DE); Stefan Melles, Stuttgart (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/913,463

(22) PCT Filed: Aug. 27, 2014

(86) PCT No.: PCT/EP2014/068137
§ 371 (c)(1),
(2) Date: Feb. 22, 2016

(87) PCT Pub. No.: WO2015/028491
PCT Pub. Date: Mar. 5, 2015

(65) Prior Publication Data

US 2016/0199239 A1 Jul. 14, 2016

(30) Foreign Application Priority Data

Sep. 2, 2013 (EP) ..... 13182567

(51) Int. Cl.
*A61G 7/05* (2006.01)
*A47C 21/00* (2006.01)

(52) U.S. Cl.
CPC ..... *A61G 7/05* (2013.01); *A61G 7/0503* (2013.01); *A47C 21/00* (2013.01)

(58) Field of Classification Search
CPC ..... A47C 21/00; A47C 21/003; A47C 21/02; A47C 21/022; A47C 21/026; A47C 21/028; A47C 31/00; A61G 7/05; A61G 7/0503; A61G 13/10; A61G 13/101; F16M 13/00; F16M 13/02; F16M 13/022
USPC ..... 5/503.1, 658, 663; 248/65, 72, 200, 248/229.1, 229.16, 226.11, 228.1, 228.7, 248/230.1, 230.7, 231.81, 313, 316.1, 248/316.7; D8/394, D8/395; D24/127, D24/128
See application file for complete search history.

(56) References Cited

U.S. PATENT DOCUMENTS

| | | | | |
|---|---|---|---|---|
| 3,175,793 | A | 3/1965 | Kennedy | |
| 3,586,276 | A | 6/1971 | O'Mahoney | |
| 5,588,166 | A * | 12/1996 | Burnett | F16L 3/1075 248/214 |
| 6,247,674 | B1 | 6/2001 | Jawidzik et al. | |
| 6,378,828 | B1 * | 4/2002 | Valiulis | A47F 5/0838 211/59.1 |
| 2003/0070236 | A1 | 4/2003 | Barker et al. | |

(Continued)

FOREIGN PATENT DOCUMENTS

| | | |
|---|---|---|
| DE | 29616032 | 1/1998 |
| JP | 2005110720 | 4/2005 |

(Continued)

*Primary Examiner* — Robert G Santos

(57) ABSTRACT

There is provided a bedrail mount (10) for detachably attaching an object (30) to a bed rail (40) of a bed. The bedrail mount comprises a U shaped bracket for positioning over a bedrail. One leg (70) of the U shaped bracket comprises a U shaped recess (20) which, when the bedrail mount rotates, receives the bed rail and prevents the bedrail mount from further rotating and getting detached from the bed rail. The object is attached to the other leg (60) of the U shaped bracket.

10 Claims, 11 Drawing Sheets

(56) References Cited

U.S. PATENT DOCUMENTS

| | | | | |
|---|---|---|---|---|
| 2008/0098524 | A1* | 5/2008 | Griesbach | A61G 13/107 5/503.1 |
| 2013/0087579 | A1 | 4/2013 | Knighton | |
| 2016/0199239 | A1* | 7/2016 | Kalka | A61G 7/05 5/503.1 |

FOREIGN PATENT DOCUMENTS

| | | |
|---|---|---|
| JP | 2005131368 | 5/2005 |
| JP | 2013128742 | 7/2013 |
| WO | 2008/050308 | 5/2008 |

* cited by examiner

BEDRAIL MOUNT

CROSS REFERENCE TO RELATED APPLICATIONS

This application is the U.S. National Phase application under 35 U.S.C. §371 of International Application No. PCT/EP2014/068137, filed Aug. 27, 2014, published as WO 2015/028491 on Mar. 5, 2015, which claims the benefit of European Patent Application Number 13182567.1 filed Sep. 2, 2013. These applications are hereby incorporated by reference herein.

TECHNICAL FIELD OF THE INVENTION

The invention relates to a bedrail mount and in particular to a bed hanger that is used to attach objects to a hospital bed.

BACKGROUND TO THE INVENTION

In a hospital objects such as a patient monitor may be attached to the hospital bed to enable a continuing monitoring of a vital sign during transport of the patient. Hence there is a need for a bedrail mount that can be used to detachably attach objects to the bed. An example of a patient monitor having a bedrail mount is disclosed in U.S. Pat. No. 6,247,674. WO2008/050308 discloses a suspension device for holding or carrying equipment. The device has legs which can flex to engage with bars of multiple geometric profiles.

It is desirable that an object such as a patient monitor can easily and reliably be attached with a bed rail mount to a bedrail and when needed again easily be detached from the bedrail without the need to clamp the bed rail mount with force (e.g. for flexing the legs of the bedrail mount) to the bedrail.

SUMMARY OF THE INVENTION

Therefore there is provided a bedrail mount for detachably attaching an object to a bedrail according to claim 1. The bedrail mount is suitable for bedrails having a diameter or bed boards having a thickness smaller than about the length of the connecting leg. To enable an easy coupling of the bedrail mount to the bedrail the opening or distance between the protrusion at the first leg and the end portion of the second leg of first U shaped portion (which is the smallest distance between the first and second legs of the first U shaped portion through which the bedrail must be able to pass before reaching the connecting leg on which it will rest) is larger than the length of the connecting leg connected between the first and second legs of the first U shaped hook portion. In use the bedrail mount will rest with its connecting leg on the bedrail. As the opening for receiving the bedrail (or bed board) is larger than the connecting leg no force is needed to flex the first and second legs when putting the bedrail mount on the bedrail. The bedrail mount comprising the first U shaped hook portion or bracket may be put over the bedrail to detachable attach the object to the bedrail, without the legs of the first U shaped portion acting with a clamping force on the bedrail. With the object being attached to the first leg of said first U shaped portion the weight of the object may cause the assembly of object and bedrail mount to rotate around the bedrail. To increase the reliability of the coupling of the object to the bedrail the bed board facing protrusion has been added to the first leg of the first U shaped hook portion to limit the amount of possible rotation. To further increase the reliability of the attachment to the bedrail the second leg of the first U shaped hook portion has a second U shaped portion forming a recess at its inner side (the side facing the first leg) for receiving the bed rail. This recess grips the bedrail or bed board in the event the bed rail mount would start rotating around the bed rail or would start to slip away over the bedrail for example due to vibrations caused by transport. The second U shaped portion prevents the bedrail mount (and the object attached thereto) from getting detached from the bed. The bedrail mount features discussed above result in a bed rail mount that enables a reliable and easy coupling of the bedrail mount to the bedrail or bed board without the need to have the legs of the bedrail mount acting with a clamping force on the bedrail. The bedrail mount has a universal and easy fit to bedrails having a diameter up to the length of about the connecting leg without the need to exert force for flexing the legs of the first U shaped portion around the bedrail.

In an embodiment the ratio of the length of the first leg of the second U shaped portion (which is closest to the end of the second leg of the first U shaped portion) and the connecting leg of the first U shaped portion is equal to or larger than 0.25. Various tests with objects of various weights attached with a bedrail mount to a bed rail did show that the ratio value of at least 0.25 provides sufficient grip to prevent the object (e.g. a patient monitor) from slipping with the bed rail mount from the bed rail.

To allow an easy access of the bedrail in the bedrail mount the opening of the first U shaped portion is larger than the length of the connecting leg of the first U shaped portion. As a result the first and second legs of the first U shaped portion are not in parallel but have an angle relative to each other larger than 10 and smaller than 45 degrees. In an embodiment the first and second legs of the first U shaped portion have an angle relative to each other in the range of 25 to 35 degrees.

In a further embodiment the ratio of the length of the protrusion and the length first leg of the first U shaped hook portion is in the range of 0.3 to 0.5. A ratio in this range provides for bed rails of a multitude of diameters a good visual angle for a patient monitor that is attached with the bedrail mount to a bed rail or bed board.

To prevent damage to the bed in an embodiment at least the connecting leg of the first U shaped portion of the bedrail mount is covered with a soft or flexible material, for example rubber. To increase the grip of the recess further the second U shaped portion may be covered with rubber.

In case a larger object needs to be coupled to the bedrail two or more bedrail mounts may be connected to each other to form a bed hanger. The second legs of the first U shaped hook portions are connected with a cross handle member to form a bed hanger. The first legs of the first U shaped hook portions are attachable, for example with screws to an object such as a patient monitor. The cross handle member may provide a gripping area for carrying the patient monitor. This bed hanger provides the advantage that also larger objects can be reliably hooked to the bed rail.

In an embodiment in addition the first legs of the first U shaped portions are connected with a further cross handle member. The further cross handle member provides more possible positions for attachment of the object to the bed hanger.

Further is provided a patient monitor comprising a bedrail mount or a bed hanger according to any of the dependent claims to allow an easy coupling of the monitor to a patient's bed.

BRIEF DESCRIPTION OF THE DRAWINGS

Various embodiments of the invention will now be described, by way of example only, with reference to the following drawings, in which.

DETAILED DESCRIPTION OF THE PREFERRED EMBODIMENTS

Figure 1:
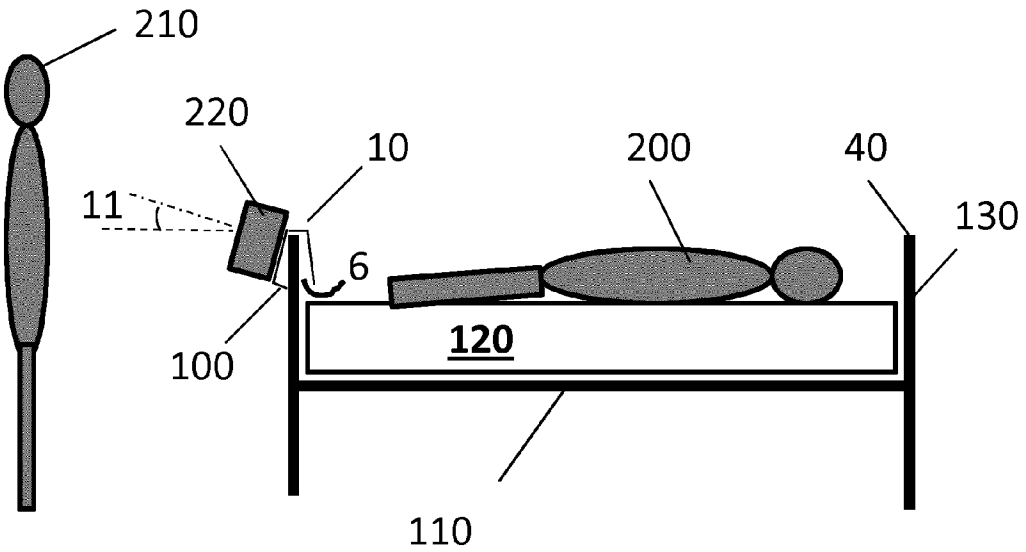
FIG. 1 is an illustration of a hospital bed with an attached patient monitor.

In FIG. 1, a bed 110 is shown that has a mattress 120 and a rectangular tubular frame construction with supports for a mattress and with a wheeled undercarriage. A typical hospital bed is supplied with additional members such as side rails, a foot and head board 130 (foot and head board together also referred to as bed board). The bedrail mount 10 according to the invention is suitable to be coupled to the side rails as well as the foot and head board. The side rail 40 shown in for example FIG. 2*a* has a circular cross section but the cross section may have other shapes as well. The top edge of the foot and head board may be rounded or edged such as shown in FIG. 3. In FIG. 1 a bedrail mount 10 is attached to the rail or the foot board and a patient monitor 220 is attached to the bedrail mount. The patient monitor measures different physiological values and can provide measurements of ECG, respiration, SpO2, blood pressure etc. of the patient 200 in the bed. If a detected physiological parameter exceeds or under-runs a preset limit an alarm is generated. The opening 6 of the bedrail mount (being the smallest distance between the end portion of the protrusion 100 and the second leg 70 of the first U shaped portion) is larger than the thickness 5 of the bed board (see FIG. 3) or the diameter 4 of the bed rail above the bed board (see FIG. 2*a*) to facilitate an easy access of the bed board or bed rail to the bedrail mount when it is coupled to the bed. The patient monitor includes a display 31 facing towards a caregiver 210. The caregiver may check the vital signs (shown on the display) of the patient 200 for example while the bed is moved to another location. FIG. 1 further shows that the bedrail mount 10 includes an abutment or protrusion 100 facing the bed board. As the legs of the bedrail mount do not clamp the bedrail mount to the bed board or bedrail the patient monitor—bedrail mount assembly may rotate around the bedrail or the top end of the bed board. To prevent a rotation of the patient monitor—bedrail mount assembly and to enable a reliable attachment of the patient monitor to various beds 110 with different dimensions for diameter of the bedrail or thickness of the bed board the inward facing protrusion 100 is added. The protrusion 100 causes the patient monitor 220 to tilt with an angle 11 (preferably in the range of 20-30 degrees) for improving the viewing angle of the monitor display for the standing caregiver 220.

Figure 2A:
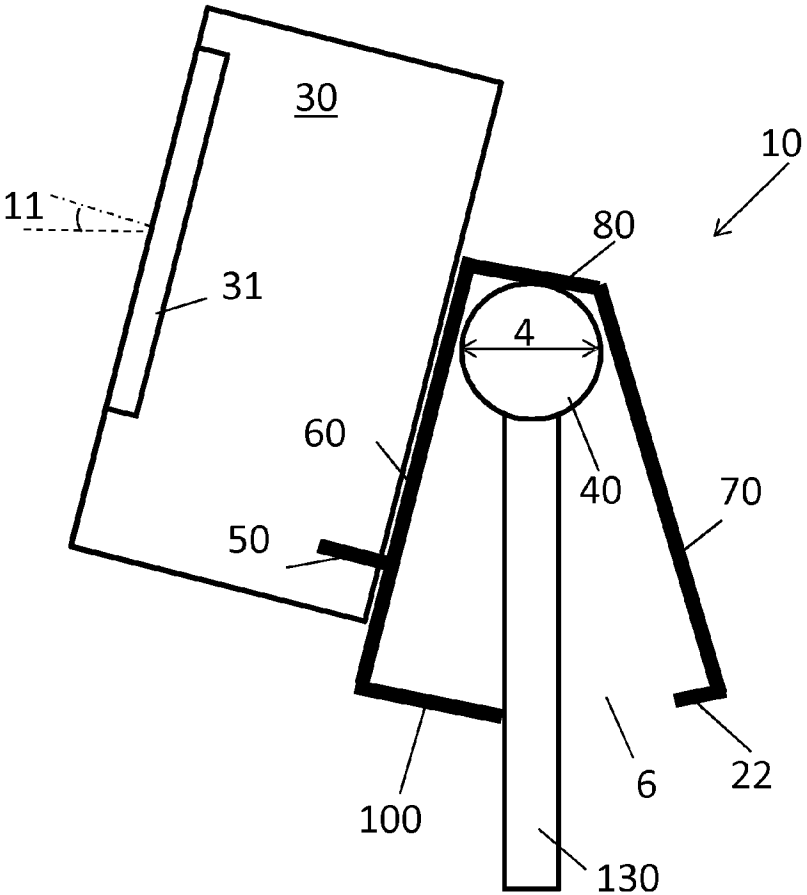
FIGS. 2*a*, 2*b*, 3, 4*a*, 4*b*, 5 and 6 show schematic drawings of embodiments of a bedrail mount.
Figure 2B:
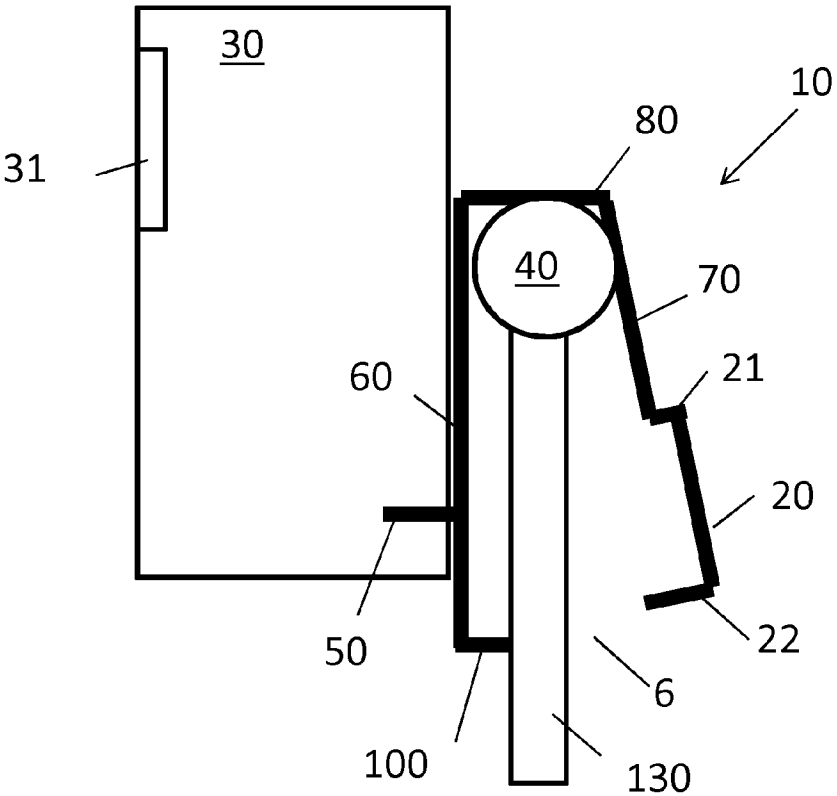
Figure 3:
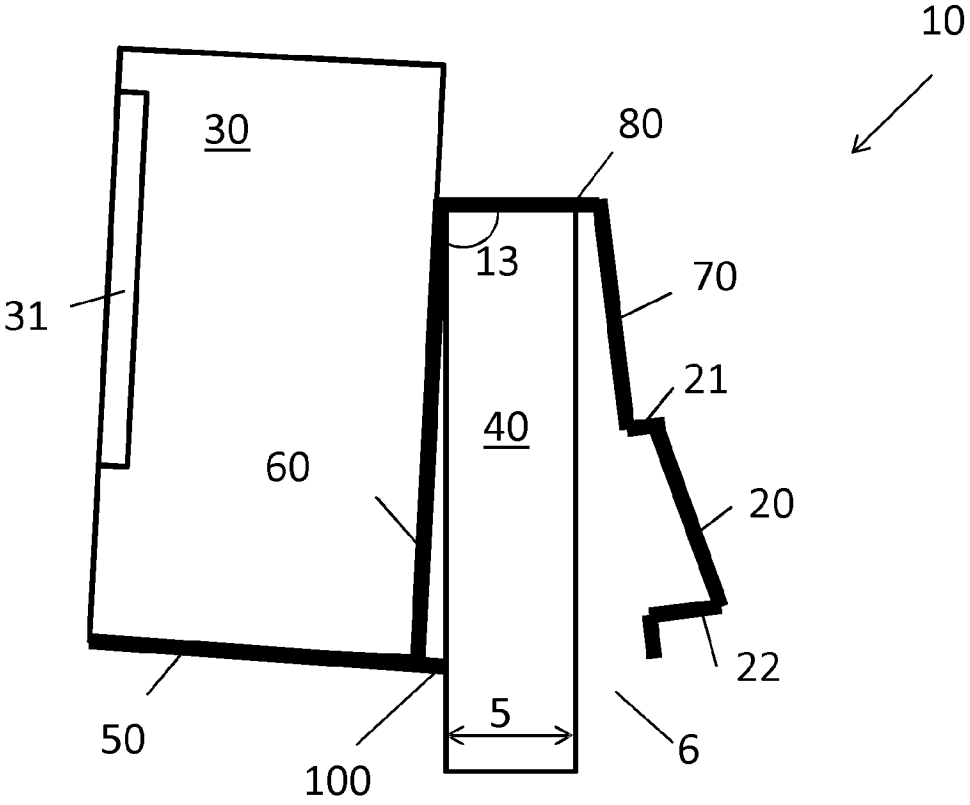

FIGS. 2*a* and 2*b* show more details on the attachment of the bedrail mount 10 to the bed rail 40 and foot board 130. For clarity only a small portion of the bed is shown. The rail and foot board may be separate components or integrated as shown in FIG. 3. The bedrail mount comprises a U shaped bracket or first U shaped hook portion which is placed over the bed rail to attach object 30 (e.g. a patient monitor) to the bed. The U shaped bracket or first U shaped hook portion has an opening 6 to allow entry of the rail 40 and foot board. The U shaped bracket or first U shaped portion is arranged for receiving the rail 40 and comprises first and second legs 60, 70 which are coupled with a connecting leg 80 opposite to the opening 6. The object is attached (or detachably attached) to the first leg, for example with straps, screws 50 or other means. The opening 6 is the smallest distance between the first and second legs 60, 70 that provides access to the connecting leg 80 on which the patient monitor—bedrail mount assembly rests. The opening 6 is larger than the diameter 4 of the bed rail or the thickness 5 of the bed board.

FIG. 2*a* further shows first and second abutments or protrusions 100, 22 at the end portions of the first and second legs 60, 70 and facing towards each other such that the opening 6 or access to the U shaped bracket is determined by the distance between the end portions of the abutments or protrusions. The length of the connecting leg 80 is about the diameter of the bedrail 40 such that in use when the bed hanger is fitted the bed rail or end of the bed board and the connecting leg are in contact with each other. The length of the connecting leg may be a little smaller than the diameter of the bedrail dependent on the angle between the connecting and second legs 80, 70 of the first U shaped hook portion. As the opening 6 must be at least as large as the diameter of the bed rail 40 the first and second legs 60, 70 are not in parallel but have an angle in the range of 10 to 45 degrees relative to each other. The second abutment or protrusion 22 prevents that the assembly of object and bedrail mount can slip from the bed rail 40 (see FIG. 4*b*). In this embodiment the second U shaped hook portion (which is included in the second leg of the first U shaped hook portion) comprises the connecting and second legs 80, 70 of the first U shaped hook portion and the protrusion 22.

FIG. 2*b* shows an embodiment in which the second leg 70 includes a U shaped recess 20 or second U shaped hook portion. The inward facing abutment or protrusion 22 forms the first leg of the second U shaped hook portion which further comprises a second leg 21 which may have a smaller length than the abutment 22. The second U shaped hook portion receives and catches the bed rail 4—in case the mount would rotate around the rail or slip around the edge of the foot or head board, see FIG. 4*a*. That may for example happen when due to transport the assembly of bedrail mount and attached object vibrates. The weight of the object 30 causes the assembly of object and bedrail mount to rotate or slip, see FIG. 6. The recess 20 or second U shaped hook portion may be formed as a U shaped trench in the second leg which may cause a protrusion at the outer side (the side facing away from the first leg of the first U shaped portion). If the second leg 70 of the first U shaped hook portion is 'thick' enough the second U shaped hook portion 20 may not cause a protrusion, see for example FIG. 10. The first and second legs of the second U shaped hook portion may have different length such as shown in FIGS. 2*b* and 3. To further increase the grip of the U shaped recess (in the second leg of the first U shaped hook portion) on the bed rail the leg 22 of the U shaped recess closest to the opening 6 is longer than the other leg 21 of the U shaped recess. The object 30 may for example be a patient monitor having a display 31 for presenting information on vital signs of a patient to a caregiver. The bedrail mount further includes the inward facing (facing towards the second leg) protrusion or abutment 100 connected to an end portion of the first leg 60 of the first U shaped hook portion (see FIG. 2*b*), opening 6 being defined by the distance between the end portions of the abutment and the first leg 22 of the second U shaped portion.

The abutment or positioning member 100 prevents that due to the absence of the bed rail mount acting with clamping force on the bedrail the weight the assembly (of patient monitor and bedrail mount) would cause it to rotate resulting in a less reliable attachment to the bedrail and to a position from which the information presented on the display 31 would be harder to read by a standing caregiver (see FIG. 1).

In FIG. 3 the first U shaped hook portion receives a foot or head board with an edged top. FIG. 3 shows another embodiment of the second U shaped hook portion in which the first leg 22 closest to the opening 6 is larger than the second leg 21 of the second U shaped hook portion. In comparison with the second U shaped portion shown in FIG. 2*b* the embodiment shown in FIG. 3 has the advantage that the opening 6 (or distance between the ends of the first and second abutments 100, 22) is not reduced by the length of the second abutment 22 making the opening relatively larger and making it easier to position the bedrail mount on the foot or head board.

Figure 4B:
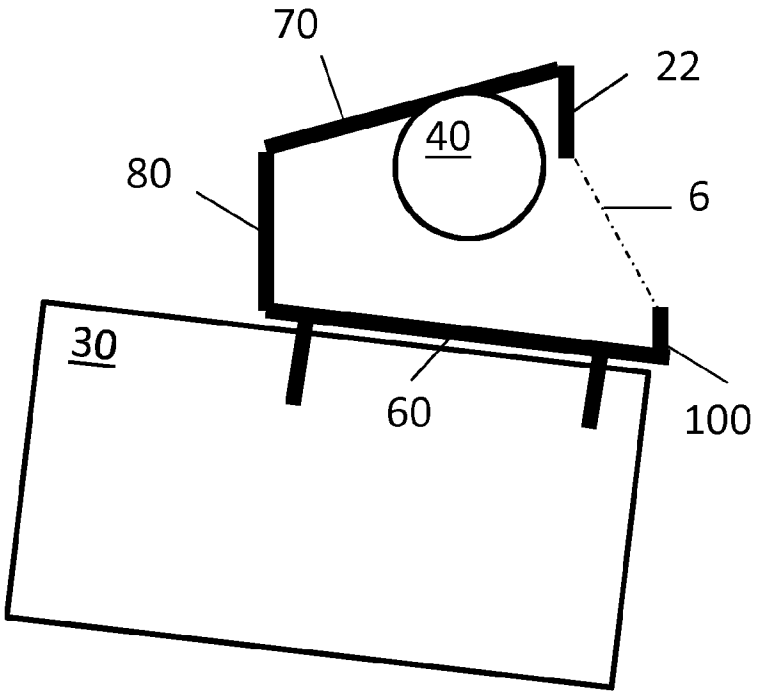
Figure 4A:
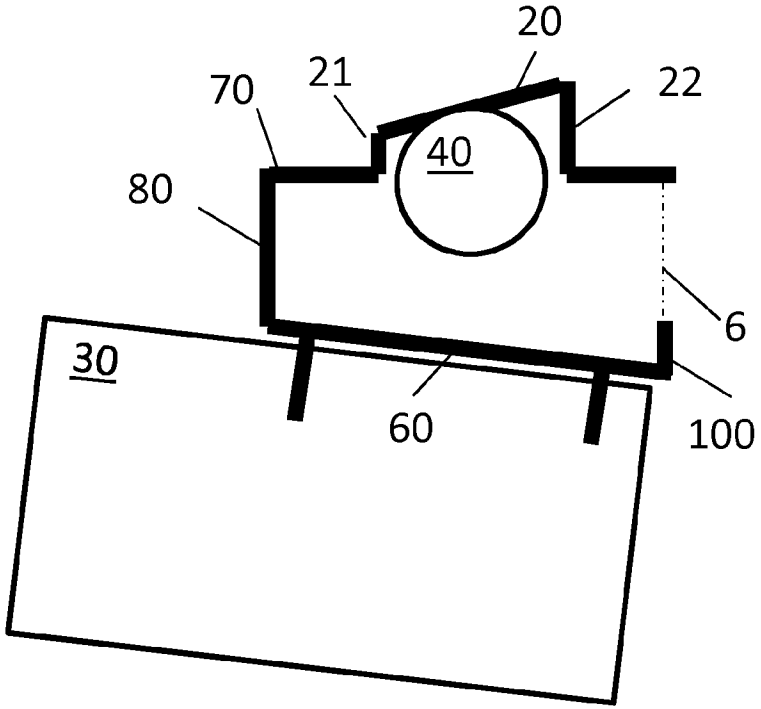

FIGS. 4*a* and 4*b* show how the second U shaped hook portion is arranged to receive the bedrail 40 and grip the bedrail preventing the assembly of object 30 and bedrail mount from falling down. As the object is attached to the outer side (the side facing away from the second leg) of the first leg 60 of the first U shaped portion the center of gravity of the assembly causes the assembly to rotate around the rail 40 when there is no head or foot board. The first leg of the second U shaped hook portion (FIG. 4*a*) or the second abutment 22 (FIG. 4*b*) will prevent the assembly from slipping from the rail and dropping to the ground. Tests have demonstrated that for the gripping portion to be most effective the ratio of length of the second abutment (or protrusion) 22 and the length of the connecting leg 80 should be larger than or equal to 0.25.

Figure 5:
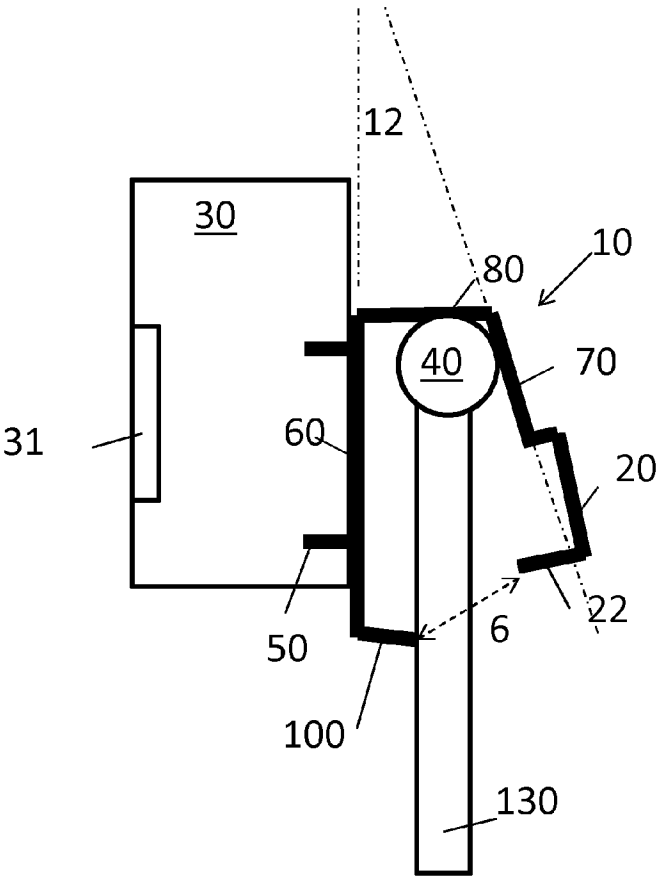
Figure 6:
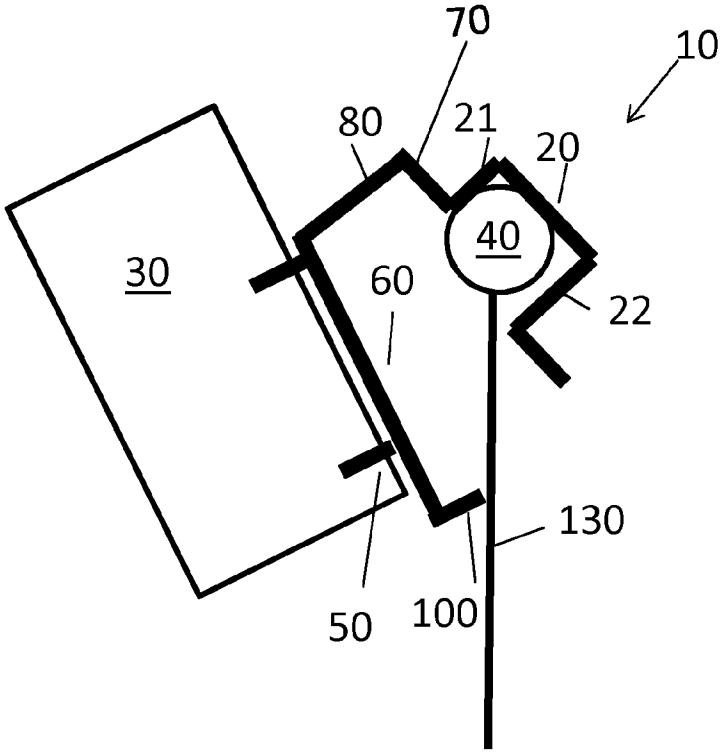

FIG. 5 shows a further embodiment of the bedrail mount that has an opening 6 (or distance between the ends of the first and second abutments (or protrusions) 100, 22) that facilitates easy attachment of a patient monitor 30—bedrail mount 10 assembly to the bed. The diameter 4 of most common types of bedrails ranges from 20 mm to 43 mm. To allow use of the bedrail mount with the various types of bedrail the length of the connecting leg 80 is preferably chosen to be close the maximum length in the range. In this embodiment the length of the connecting leg 80 of the first U shaped hook portion is larger than the diameter of the bed rail. Due to the weight of the object 30 the bed rail mount may slide such that the bedrail rests against both the connecting and second legs 80, 70 of the first U shaped hook portion. In absence of the first abutment (or protrusion) 100 the object-bedrail mount assembly will rotate around the bed rail potentially reducing the reliability of the attachment to the bed (see for example FIG. 6 showing abutment 100 preventing the assembly from further tilting thereby contributing to the gripping function of the second U shaped hook portion). To provide an easy access to bedrails having a diameter of about the length of the connecting leg the first and second legs 60, 70 of the first U shaped hook portion are not in parallel such that opening 6 exceeds the diameter 4 of the bedrail (or the thickness 5 of the bed board). The imaginary lines though the first and second legs 60, 70 cross each other and the angle 12 between these lines (and between the first and second legs relative to each other) is in the range of 20 to 40 degrees, and preferably about 30 degrees. The second abutment 22 at the end of the second leg 70 forms together with recess 20 a gripping portion for preventing the assembly of monitor and bedrail mount from slipping of the bedrail 40, see FIG. 6. In an embodiment the opening is about 45 mm and the length of the connecting leg 80 of the first U shaped hook portion is about 35 mm.

FIG. 6 shows an embodiment of a patient monitor 30—bedrail mount assembly in which the U shaped recess 20 in the inner side (or side facing towards the first leg) of the second leg of the first U shaped hook portion grips and holds the bed rail 40. Due to movement of the bed, for example caused by transport, the assembly vibrates and may start sliding and rotating. The U shaped recess 20 provides a second gripping position preventing the assembly from falling of the bed, the first gripping position being formed by the first U shaped hook portion comprising the first and second legs 60, 70 and the connecting leg 80 on which the assembly rests, see FIG. 5.

Figure 7:
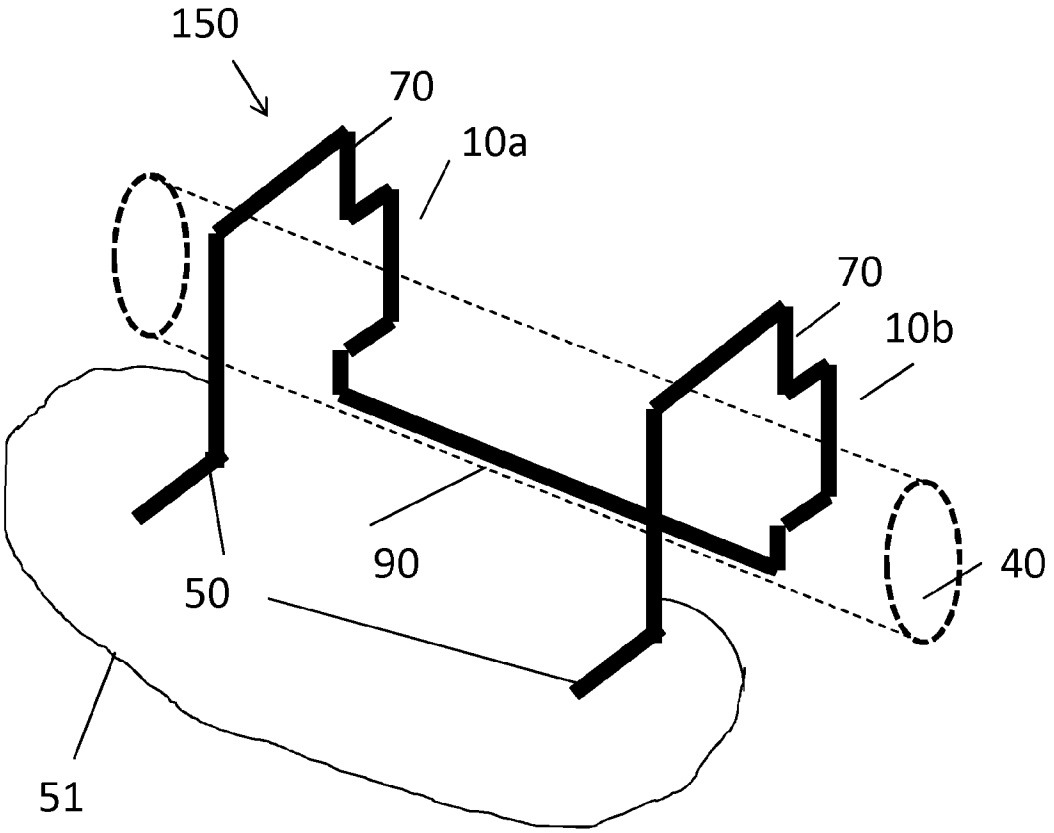
FIGS. 7, 8 and 9 show schematic drawings of embodiments of a bed hanger.

FIG. 7 shows an embodiment of a bed hanger 150 comprising two bedrail mounts 10*a*, 10*b* coupled at the second legs of the first U shaped hook portions with a cross handle member 90. The cross handle member 90 facilitates the carrying of the object—bed hanger assembly. The bed hanger has attachment means 50, 51 for fastening an object to the bed hanger. The attachment means comprise supports 50 extending away from the first legs of the first U shaped hook portions. The object 30 may be placed on the supports and secured to the first legs with a strap 51.

Figure 8:
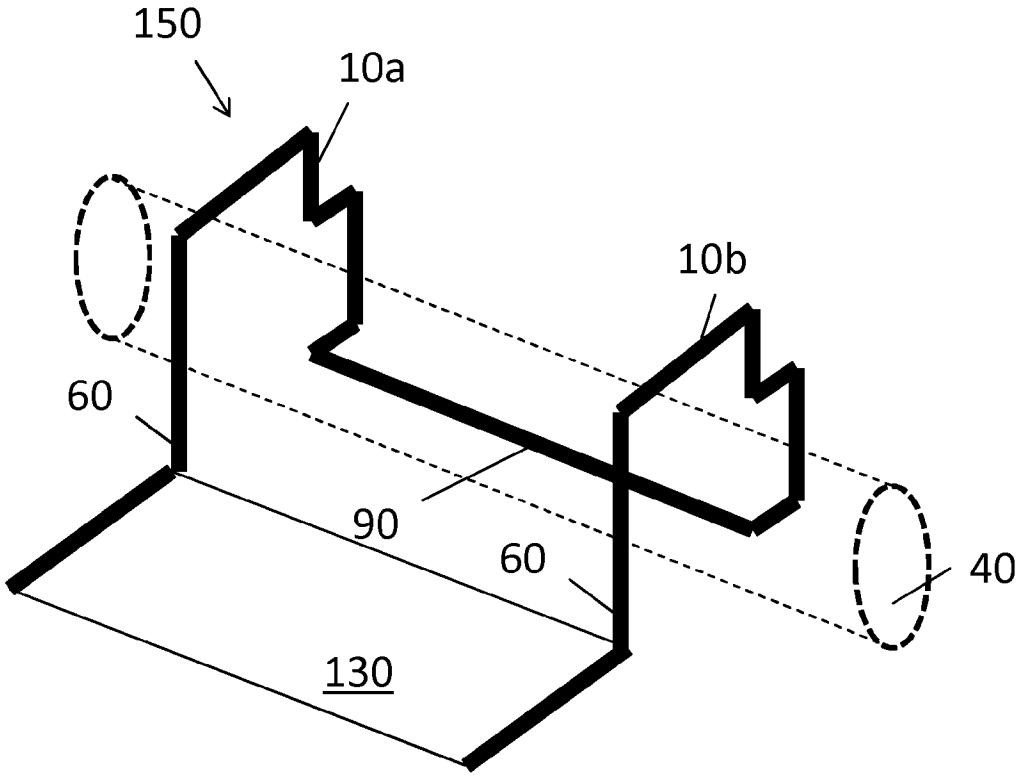

FIG. 8 shows another embodiment of the bed hanger 150 in which a further cross handle member 130 couples the first legs 60 of the first U shaped hook portions of the two bedrail mounts 10*a*, 10*b*. The further cross handle member may be L-shaped such that it extends in a direction away from the first legs of the first U shaped hook portion thereby forming a support to which an object can be attached, for example with screws.

Figure 9:
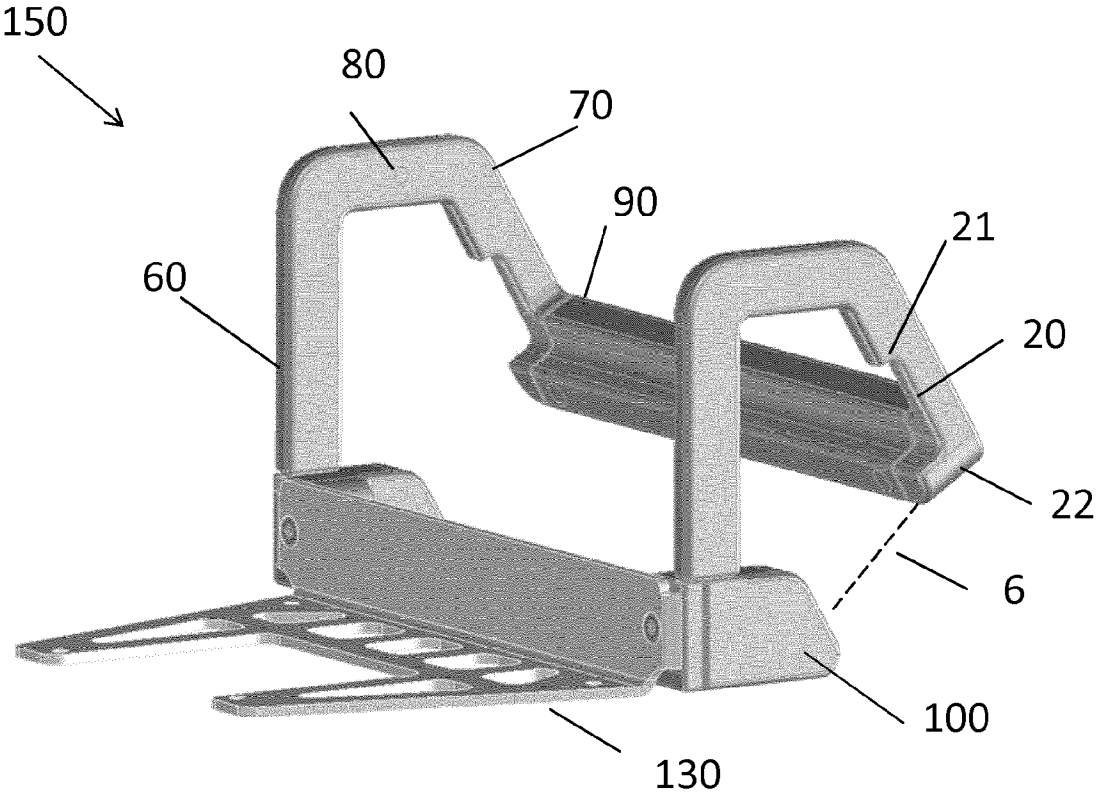

FIG. 9 shows schematically another embodiment of a bed hanger 150 in which many features previously discussed are included. Each bedrail mount includes a first U shaped bracket or hook portion in which the first and second legs 60, 70 are not in parallel to create wider access (see opening 6) for easy placement around a bed rail or board. Further cross member handle 130 acts as a support for an object such as a patient monitor. In the second leg 70 of the first U shaped hook portion a second hook shaped portion 20 is included. The (in use) ground facing side of the object may be attached to the support 130 with screws. When positioned over the bedrail, head or foot board the abutments 100 prevent a downward tilting of the display of the patient monitor positioned on the support 130 as the positioning members 100 limit the rotating movement of the bed hanger—patient monitor assembly around the bed rail (see FIG. 10*b*). The L shaped cross handle member 90 couples the second legs 70 of the first U shaped hook portions to each other.

Figure 10B:
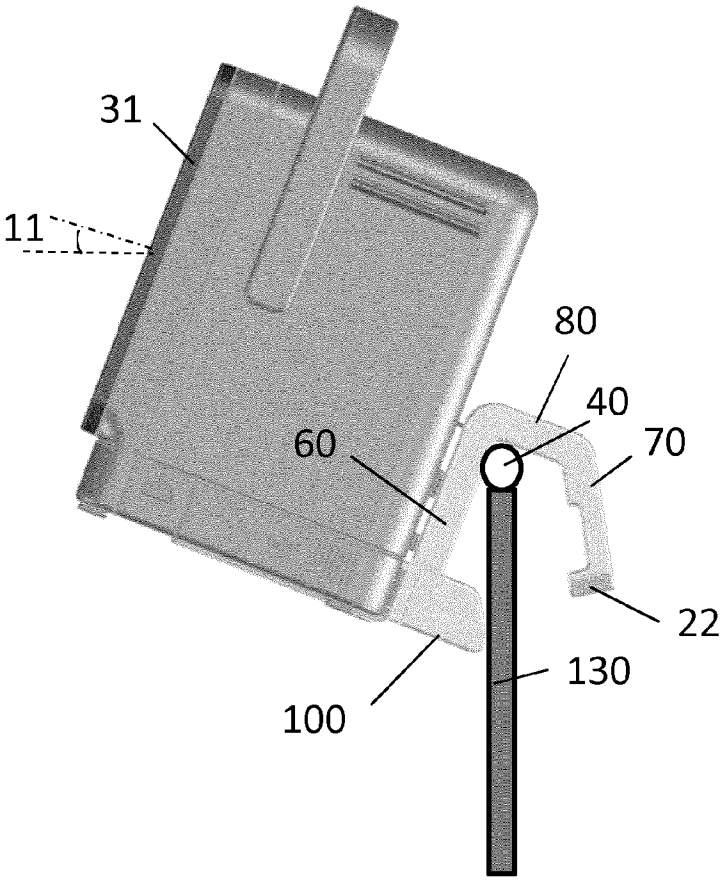
FIGS. 10*a* and 10*b* show an embodiment of a patient monitor comprising a bed hanger.
Figure 10A:
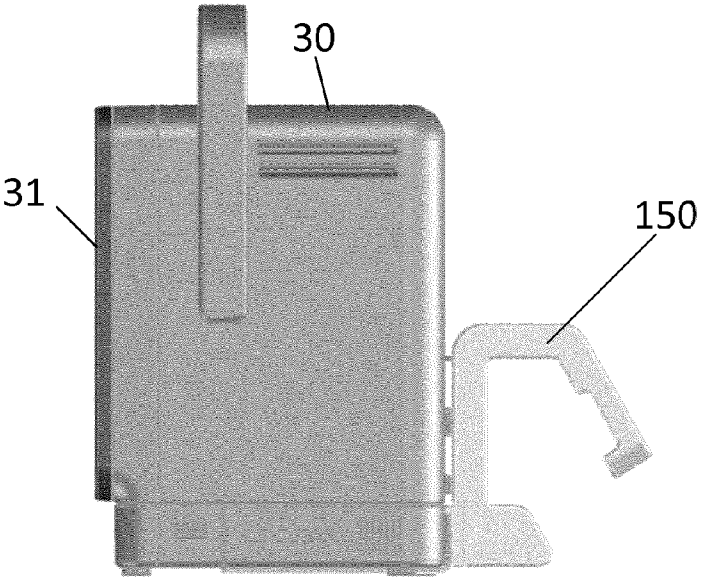

FIGS. 10*a* and 10*b* show assemblies of a patient monitor 30 and the bed hanger 150 earlier shown in FIG. 9. The bed hanger may be detachably attached to the patient monitor or fixed to it, for example with screws. The bed hanger extends from the rear side of the monitor. FIG. 10*b* shows the assembly being positioned with the bed rail mounts on the bed rail 40. In use when the bedrail is received in the first U shaped hook portion the first protrusion 100 causes an angle between the first leg of the bed rail mount and the bed board 130 in the range of 20 to 30 degrees. Hence the ratio of the length of the protrusion 100 (which is extending perpendicular from the first leg) and the length of the first leg 60 of the first U shaped hook portion is preferably in the range of arctan ($\pi/9$)—arctan ($\pi/6$) or from about 0.3 to about 0.5.

Summarizing there is provided a bedrail mount 10 for detachably attaching an object 30 to a bed rail 40 of a bed. The bedrail mount comprises a U shaped bracket for positioning over a bedrail. One leg 70 of the U shaped bracket comprises a U shaped recess 20 which, when the bedrail mount rotates, receives the bed rail and prevents the bedrail mount from further rotating and getting detached from the bed rail. The object is attached to the other leg 60 of the U shaped bracket Variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. Any reference signs in the claims should not be construed as limiting the scope.

The invention claimed is:

1. A bedrail mount for detachably attaching an object to a bedrail or bed board, the bedrail mount comprising first and second U shaped hook portions for receiving the bedrail or bed board, each U shaped hook portion comprising, a first leg, a second leg and a connecting leg connecting the first and second legs, wherein the first leg of the first U shaped hook portion is attachable to the object and comprises at its end portion a protrusion pointing towards the second leg of the first U shaped hook portion, the second leg of the first U shaped hook portion including the second U shaped hook portion, the first and second U shaped hook portions having an opening for receiving the bedrail or bed board, the opening of the second U shaped hook portion facing towards the first leg of the first U shaped hook portion, the first leg of the second U shaped hook portion being positioned at an end portion of the second leg of the first U shaped hook portion, the opening of the first U shaped hook portion being the smallest distance between the end portion of the protrusion and the second leg of the first U shaped portion, the opening of the first U shaped hook portion being larger than the length of the connecting leg connecting the first and second legs of the first U shaped hook portion.

2. The bedrail mount according to claim 1 wherein the length of the second U shaped hook portion has a same length as the first U shaped hook portion.

3. A bedrail mount according to claim 1 wherein the first leg of the second U shaped hook portion is longer than the second leg of the second U shaped hook portion.

4. A bedrail mount according to claim 1 wherein the ratio of the length of the first leg of the second U shaped hook portion and the connecting leg of the first U shaped hook portion is equal to or larger than 0.25.

5. A bedrail mount according to claim 1 wherein the first and second legs of the first U shaped hook portion have an angle relative to each other in the range of 25 to 35 degrees.

6. A bedrail mount according to claim 1 wherein the protrusion is oriented perpendicular to the first leg of the first U shaped hook portion, and wherein the ratio of the length of the protrusion and the length of the first leg of the first U shaped hook portion is in the range of 0.3 to 0.5.

7. A bedrail mount according to claim 1 further comprising a support member connected at the end portion of the first leg of the first U shaped hook portion, the object being attachable via the support member to the first leg.

8. A bed hanger for attaching an object to a bed, the bed hanger comprising a first and a second bedrail mount according to claim 1, the second legs of each of the first U shaped hook portions of the first and second bedrail mount being connected with a cross handle member.

9. A bed hanger according to claim 8 comprising a further cross handle member being connected to the ends of the first legs of each of the first U shaped hook portions of the first and second bedrail mounts, the further cross handle member being arranged to detachably attach to the object.

10. A patient monitor comprising a bedrail mount or a bed hanger according to claim 8.

* * * * *